US007083059B1

(12) United States Patent
Le Guen

(10) Patent No.: US 7,083,059 B1
(45) Date of Patent: Aug. 1, 2006

(54) THERMOPLASTIC CONTAINER WITH PETALOID BASE

(75) Inventor: Vincent Le Guen, LeHavre Cedex (FR)

(73) Assignee: Sidel S.A., Le Havre Cedex (FR)

( * ) Notice: Subject to any disclaimer, the term of this patent is extended or adjusted under 35 U.S.C. 154(b) by 0 days.

(21) Appl. No.: 09/582,292

(22) PCT Filed: Dec. 21, 1998

(86) PCT No.: PCT/FR98/02801

§ 371 (c)(1),
(2), (4) Date: Jun. 23, 2000

(87) PCT Pub. No.: WO99/33708

PCT Pub. Date: Jul. 8, 1999

(30) Foreign Application Priority Data

Dec. 23, 1997 (FR) ..... 97 16752

(51) Int. Cl.
*B65D 90/12* (2006.01)

(52) U.S. Cl. ..... 215/375; 215/373; 220/606

(58) Field of Classification Search ..... 215/375, 215/374, 376, 377, 378, 373; 220/606, 608, 220/623, 627, 675, 605, 609, 624
See application file for complete search history.

(56) References Cited

U.S. PATENT DOCUMENTS

| | | | | | |
|---|---|---|---|---|---|
| 4,249,667 | A | * | 2/1981 | Pocock et al. | 215/1 C |
| 4,368,825 | A | * | 1/1983 | Motill | 215/1 C |
| 4,721,223 | A | * | 1/1988 | Jakobsen | 220/605 |
| 5,454,481 | A | | 10/1995 | Hsu | |
| 5,906,286 | A | * | 5/1999 | Matsuno et al. | 215/375 |

FOREIGN PATENT DOCUMENTS

WO WO 86 05462 A 9/1986

* cited by examiner

*Primary Examiner*—Lien Ngo
(74) *Attorney, Agent, or Firm*—Sughrue Mion, PLLC

(57) ABSTRACT

A thermoplastic container, such as a bottle, obtained by extrusion-blow or injection-blow molding and having a petaloid base (6, 7). The base includes a convex wall (7) hemispherical in shape; the wall (7) is linked to the wall (2) forming the container body by a marginal zone (8) with a curve (R1, R2). Members (6) originate from the hemispherical wall (7) and are separated in pairs by a part thereof; the top end of each member is directly linked to the wall (2) forming the body.

12 Claims, 2 Drawing Sheets

THERMOPLASTIC CONTAINER WITH PETALOID BASE

THERMOPLASTIC CONTAINER WITH PETALOID BASE

The invention concerns perfections of containers with a "petaloid"-type base, such as bottles, pots, or any other container with such a base and which is obtained either by blow molding, or drawing followed by blow molding, of a preform injected in thermoplastic material (injection blow molding), or by extrusion followed by blow molding of a parison (extrusion-blow molding). The invention concerns in particular perfections of such types of bases.

The production of containers with such a type of base has been known for a number of years now. So far, different thermoplastic materials have been used, e.g. polyethylene teraphthalate (PET), polyethylene naphthalate (PEN), polyacrylonitrile (PAN) as well as other materials. In addition, it is also known from prior art to use these materials either by themselves or mixtures thereof or with a variety of additives (bonding agents, coloring agents), in superimposed layers.

One known problem of thermoplastic containers is, regardless of how they are fabricated and to be filled, is the behavior of their base under stress: the base tends to deteriorate, deform or burst when the full container is dropped or subject to internal overpressure. This particularity is due to the fabrication processes per se in that the material, in the base area, is less stretched than in other areas of the container. As a matter of fact, it is known from prior art that the more the material is stretched during blow molding, the higher its strength. As a matter of fact, stretching (or blowing) leads to a change in crystallinity of the material: an area which is not stretched after the injection or extrusion remains amorphous, whereas a stretched area becomes even more crystallized; therefore, resistance increases as stretching continues.

The preforms used in the injection blow molding processes, however, like the parisons used in the extrusion-blow molding processes, are shaped in the form of tubes which are either blown or stretched and then blown.

The longitudinal axis of the preform or of the parison corresponds to that of the final container; as a result thereof, both during possible stretching as well during blowing, the stretching of the material is zero or almost zero in the center of the base and increases towards the wall of the container.

It has been suggested to correct these disadvantages by providing containers with a thick base, i.e., with a significant quantity of material in the base.

This solution is not satisfactory for at least two reasons:

- first and foremost, the containers obtained are very unaesthetic and therefore difficult to promote;
- furthermore, due to the significant amount of material at the base level, these containers are higher in production costs, since the material is the main component of production cost.

It has also be suggested to make the base of the containers lighter to make them more esthetically acceptable and to reduce the production cost.

It has therefore been suggested to provide containers with petaloid bases.

This type of container comprises a cylindrical part forming the body of the container and, in its lower part, a base wall generally shaped convexly towards the outside where the members (typically between 4 and 6 members) originate which are formed by outgrowths regularly distributed on the base in pairs by part of the convex base wall.

The base is provided in such a way that, in case the empty container stands upright, there is sufficient clearance between the central part of the convex wall and the supporting plane of the base of the members. The clearance is such that, while the filled container is deformed, either due to the weight of its content or due to the prevailing internal pressure in the container (in the case the latter is e.g., a bottle filled with a carbonated beverage), it remains stable, even in case the central part approaches the supporting plane during deformation.

Petaloid-shaped bases known from prior art, however, are disadvantageous in that the may burst under the internal pressure which may exist in the container, as a result of the shape of the convex part and/or of the link between the members and the latter and with the cylindrical wall of the container.

In certain cases, the convex part therefore has variations or inversions of the curve between its link with the container wall and its central point.

- for example, the central area of the convex part can be circular flat pellet: in this case, under the internal pressure, this area may at times tend to deform and be pushed towards the lower part of the container, so that microcracks appear in this area, or the pellet separates from the rest of the base.
- again for example, the central area of the generally convexly shaped part can be provided in the form of a concave dome turned towards the outside; the peripheral limit of the central part constitutes a rupture zone.

Another problem is that in the petaloid base structures known from prior art, the height of the base, and therefore of the members, must increase as the diameter grows larger.

As a result thereof, in the case of containers with a large diameter but little height, the members are very awkward.

The object of this present invention is therefore to eliminate the aforementioned disadvantages and to provide a container with a resistant petaloid base whose proportions remain acceptable under any circumstances.

According to this present invention, a monolithic container with a roughly cylindrical wall and a petaloid-type base which extends such wall, wherein the base comprises a generally convexly shaped wall towards the outside where at least three members originate which are formed by outgrowths regularly distributed at the periphery of the base and separated in pairs by a portion of the convex base wall is characterized in that the base wall is hemispherical, expect for a peripheral marginal linking area with the cylindrical wall, in that aforesaid marginal zone has a curve with an inflection so that the link between the base wall and the peripheral marginal zone as well as the link between the cylindrical wall and the peripheral marginal area are achieved in an almost tangential manner, and in that the top end of each member is linked with the cylindrical wall.

A container with the above features resolves all of the aforementioned problems.

It is resistant since, on one hand, the presence of the hemispherical wall makes it possible to distribute the stresses caused by the internal overpressure or by the weight of the content in an uniform manner. As a result, special areas which are susceptible to breakage cracks are eliminated.

On the other hand, the marginal linking area, in turn, can deform under stress action, which reduces the stresses exerted on the hemispherical wall even further. However, the location and the curve of the marginal area are such that deformation is limited, and the risks of rupture are nonexistent; as a matter of fact, in the marginal area, the material is stretched to a high degree, and the mechanical strength is therefore increased; in addition thereto, the shape of the curve (inflected) allows it to deform without stretching the material too much; furthermore, the almost tangential link with the peripheral wall on one hand and with the hemispherical part on the other prevents the occurrence of rupture or tearing areas; finally, since the top end of each of the members is linked with the peripheral wall, a mechanical reaction occurs between the top ends of two adjacent members and the inflected marginal part located between these members, as a result of which the deformation of the marginal part under the stress is limited.

This structure makes it possible to maintain acceptable proportions regardless of the dimensions of the container: if is sufficient, for example, to chose a suitable curve radius for the hemispherical part and/or to move the location of the center of the curve relative to the longitudinal axis of the container, or rather to adapt the curve and the dimensions of the marginal zone.

In another embodiment, each member is linked in a roughly tangential manner in the direction of the central pole of the hemispherical part.

As a result, the absence of a interruption of the slope or, in addition, the presence of a slight slope at this junction between the members and the hemispherical zone eliminates any fragilization areas.

In one embodiment, said link is created in immediate proximity of the central pole of the hemispherical part.

The members and said part therefore mutually reinforce each other. This constitutes a significant advantage in case the container is produced by blow molding a preform which has been injected prior thereto: as a matter of fact, in this case, the central pole of the container is represented by the injection point of the material. It is known, however, that this pole represents a fragile area. The mutual reinforcement between the members and the hemispherical part therefore greatly increases the strength of the container.

Other features and advantages of the invention are described below with reference to the Figures enclosed herewith.

Figure 6A:
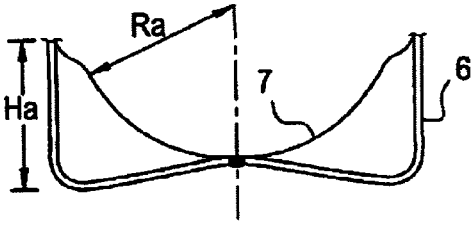
Figure 6B:
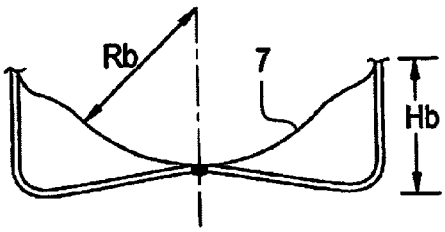
Figure 6C:
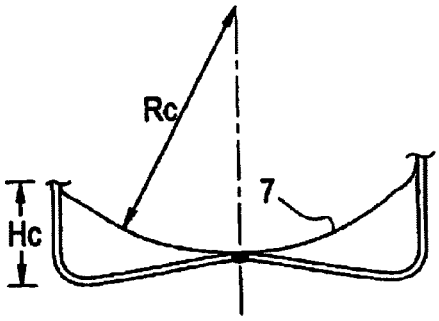

FIGS. 6A, 6B, and 6C illustrate how the relative height of the base can vary in containers of the same diameter.

Figure 1:
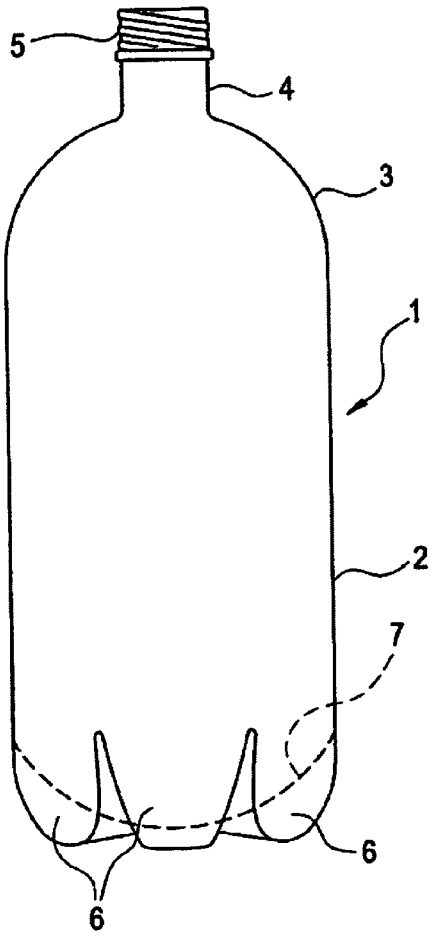
FIG. 1 represents a side view of a bottle made from a plastic material to which the invention applies.

The monolithic container shown in FIG. 1 is a bottle 2, e.g. for a gaseous or carbonated beverage. The container is made from a thermoplastic material known from prior art (PET, PAN, or the like) or from a mixture of different materials, by extrusion blow molding or injection blow molding its base material. As a matter of fact, this present invention is preferably applied to this type of container.

This container comprises a body 2 forming a cylindrical wall, with a shoulder 3, terminating in a collar 4, terminated by a neck 5 which is threaded or adapted in another manner to receive a plug (not shown herein).

The base comprises members 6 formed by outgrowths originating in a convex hemispherical wall 7 which is turned towards the outside. The top end of each member terminates in the body 2.

Figure 2:
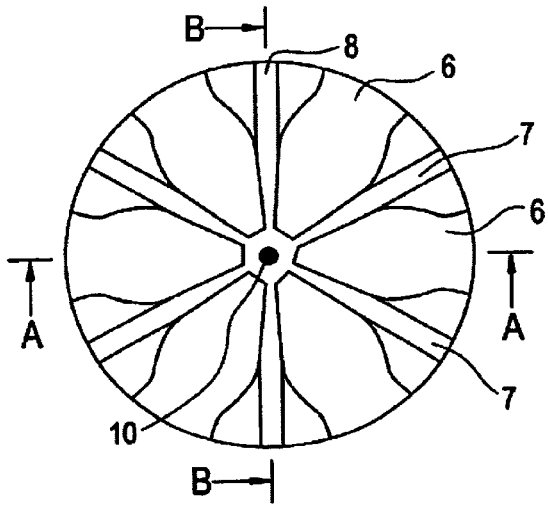
FIG. 2 represents a schematic bottom view of a base according to this present invention.

As shown in FIG. 2, the members 6 are uniformly distributed over the base and are separated in pairs by a part of the hemispherical wail 7.

In this present example, six members are shown. A different number of members may also be used.

Figure 3:
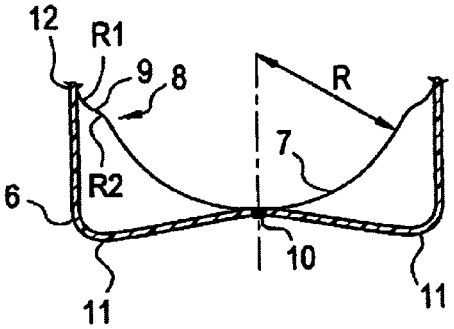
FIG. 3 represents a partial view of the section AA in FIG. 2.
Figure 4:
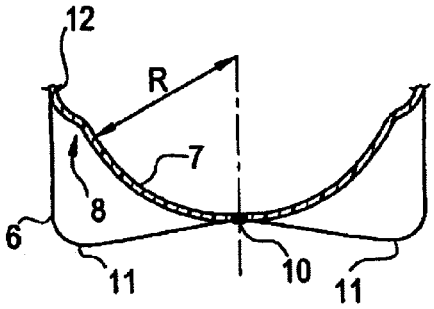
FIG. 4 represents a partial view of the section BB in FIG. 2.

As shown in FIGS. 3 and 4, the convex hemispherical part 7 in which the members 6 originate is linked with the cylindrical wall 2 (body) of the container 1 by a marginal linking area 8 with a curve with an inflection 9 so that the convex hemispherical part 7 and the bode form a monolithic structure. The curve radiuses R1, R2 on both sides of the inflection point 9 are determined so that the marginal zone 8 is linked, on one hand, with the wall 2 of the container and, on the other, with the convex hemispherical part 7 in an almost tangential manner, i.e. without notable interruption of the slope in the linking areas, so as not to create a point of fragility at the level of these areas.

Preferably, the curve radius R of the hemispherical part 7 is chosen in such a way that it comprises between 80% and 120% of the radius of the cylindrical wall 2 of the container 1.

Values below the aforementioned lower limit create a marginal area 7 which is too large, on one hand, and members which are relatively high compared with the container.

Values above the aforementioned upper limit lead to difficulties in terms of designing a non-inflected area with certain mechanical efficacy.

The height of the members 6 is set in such manner as to create a clearance between the central pole 10 of the hemispherical part 7 and the plane passing through the supporting surface 11 of each of the members 6.

Because of the monolithic structure of the container, the end of each of the members at the top edge 12 is directly linked with the wall 2.

Preferably, the members 6 and the wall 2 are joined tangentially, as shown in FIGS. 3 and 4.

Finally, it is preferred that each member 6 and the hemispherical part 7, in the direction of the central pole 10 of the latter, are joined in an almost tangential manner.

In the embodiment shown, this junction is created in the immediate proximity of the central pole 10.

Figure 5:
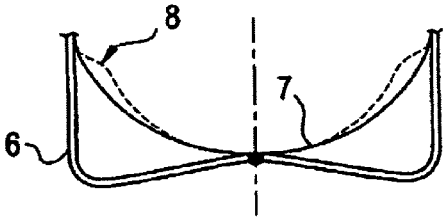
FIG. 5 represents a partial view of the section AA of the base depicted in FIG. 2 upon deformation under internal stresses.

FIG. 5 represents a sectional view of the shape the base assumes under stress (internal overpressure or heavy liquid).

As a matter of fact, it is mainly the marginal area 8 located between two members which is deformed to absorb the stress. The hemispherical part 7 in turn does not undergo major deformation. As a matter of fact, the marginal area assumes the shape of a curve whose convexity is turned towards the outside, extending the curve of the hemispherical part. In this figure, the initial shape of the parts 7 and 8 is indicated by dotted lines.

However, since the top end of the members 6 is linked with the wall 2, i.e; the container is a monolithic structure, this arrangement of the members limits the overall deformation of the base.

As shown in FIGS. 6A through 6C, by varying the radius R of the curve of the hemispherical wall 7 and/or the dimensions and/or the shape (width and/or average slope and/or curve radiuses R1, R2) of the marginal zone, the relative height of the base and of the container can be changed.

Therefore, in FIG. 6B, the diameter of the container is identical to that shown in FIG. 6A, the curve radius Rb of the hemispherical part 7 is identical to Ra of the corresponding part in FIG. 6A, but the marginal area in FIG. 6B is wider.

As a result thereof, the height Hb of the hemispherical part is lower than that in FIG. 6B, so that the overall height of the base shown in FIG. 6B is smaller than Ha depicted in FIG. 6A.

In FIG. 6C, the curve radius Rc of the hemispherical area is lower than Ra or Rb in FIGS. 6A and 6B, and the width of the marginal area and its average slope are identical to those shown in FIG. 6A. As a result thereof, the height Hc of the base of FIG. 6C is lower that the height Ha of the base shown in FIG. 6A.

The invention is not limited to the embodiments described; it rather covers all equivalent embodiments.

What is claimed is:

1. A monolithic container (1) with a substantially cylindrical wall (2) and a petaloid-shaped base (6,7) which extends from the substantially cylindrical wall, said base comprising a wall that is shaped substantially convexly towards an outside of the container, wherein at least three members (6) originate from the substantially cylindrical wall and are formed by outgrowths that are regularly distributed and separated in pairs by a portion of the convex base wall (7), wherein:

the base wall (7) is hemispherical, except for a peripheral marginal linking area (8) with the cylindrical wall, said peripheral marginal linking area (8) has a curve (R1; R2) with an inflection (9) so that the base wall and the peripheral marginal linking area as well as the cylindrical wall and the peripheral marginal linking area are linked in an almost tangential manner, and a top end of each member is connected with the cylindrical wall (2), wherein said inflection (9) is a change in curvature of said curve (R1; R2) from a concave curve to a convex curve.

2. A container according to claim 1, wherein the members (6) are linked with the hemispherical wall (7), in the direction of a central pole (10) of the hemispherical wall (7), in a roughly tangential manner.

3. A container according to claim 1, wherein the members (6) are linked with the hemispherical wall (7), in the direction of a central pole (10) of the hemispherical wall (7), in immediate proximity of the hemispherical wall (7).

4. A one-piece blow molded plastic container (1) with a substantially cylindrical wall (2) and a petaloid-shaped base (6,7) which extends from the substantially cylindrical wall, said base comprising a wall that is shaped substantially convexly towards an outside of the container, wherein at least three members (6) originate from the substantially cylindrical wall and are formed by outgrowths that are regularly distributed and separated in pairs by a portion of the convex base wall (7), wherein:

the base wall (7) is hemispherical, except for a peripheral marginal linking area (8) with the cylindrical wall, said peripheral marginal linking area (8) has a curve (R1; R2) with an inflection (9) so that the base wall and the peripheral marginal linking area as well as the cylindrical wall and the peripheral marginal linking area are linked in an almost tangential manner, and a top end of each member is connected with the cylindrical wall (2), wherein said inflection (9) is a change in curvature of said curve (R1; R2) from a concave curve to a convex curve; and wherein the curve radius (R) of the hemispherical wall (7) is between 80% and 120% of the radius of the cylindrical wall (2).

5. A container according to claim 1, wherein a clearance is provided between a central pole (10) of the hemispherical part and a supporting surface (11) of each member (6).

6. A container according to claim 1, wherein the top end of the members (6) is linked with the cylindrical wall (2) in a substantially tangential manner.

7. A container according to claim 1, further comprising a shoulder (3), a collar (4), a neck (5), and means for closing the container by means of a suitable device.

8. The container according to claim 4, wherein the members (6) are linked with the hemispherical wall (7), in the direction of a central pole (10) of the hemispherical wall (7), in a roughly tangential manner.

9. The container according to claim 4, wherein the members (6) are linked with the hemispherical wall (7), in the direction of a central pole (10) of the hemispherical wall (7), in immediate proximity of the hemispherical wall (7).

10. The container according to claim 4, wherein a clearance is provided between a central pole (10) of the hemispherical part and a supporting surface (11) of each member (6).

11. The container according to claim 4, wherein the top end of the members (6) is linked with the cylindrical wall (2) in a substantially tangential manner.

12. The container according to claim 4, further comprising a shoulder (3), a collar (4), a neck (5), and means for closing the container by means of a suitable device.

* * * * *